US007871067B2

(12) United States Patent
Lim

(10) Patent No.: US 7,871,067 B2
(45) Date of Patent: Jan. 18, 2011

(54) PAPER CASSETTE FEEDER FOR EASILY REMOVING PAPER JAM AND IMAGE FORMING APPARATUS HAVING THE SAME

(75) Inventor: Kwang-taek Lim, Gwangmyeong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 421 days.

(21) Appl. No.: 11/640,392

(22) Filed: Dec. 18, 2006

(65) Prior Publication Data

US 2007/0164500 A1 Jul. 19, 2007

(30) Foreign Application Priority Data

Jan. 14, 2006 (KR) ..... 10-2006-0004172

(51) Int. Cl.
*B65H 5/26* (2006.01)

(52) U.S. Cl. ..... 271/9.13; 271/9.11; 271/145

(58) Field of Classification Search ..... 271/9.13, 271/9.04, 9.11, 145
See application file for complete search history.

(56) References Cited

U.S. PATENT DOCUMENTS 4,734,738 A * 3/1988 Yamanaka et al. ..... 271/9.13
5,405,128 A * 4/1995 Fujiwara et al. ..... 271/9.13

FOREIGN PATENT DOCUMENTS

JP 04064540 A * 2/1992
JP 5-69983 3/1993
JP 6-144620 5/1994
JP 7-076438 3/1995
JP 07-076438 A * 3/1995
JP 9-221247 8/1997
JP 2002-053243 2/2002

OTHER PUBLICATIONS

Office Action issued in Korean Patent Application No. 2006-4172 on Apr. 25, 2007.
Office Action issued in Korean Patent Application No. 2006-4172 on Apr. 25, 2007.

* cited by examiner

*Primary Examiner*—Stefanos Karmins
*Assistant Examiner*—Gerald W McClain
(74) *Attorney, Agent, or Firm*—Staas & Halsey LLP

(57) ABSTRACT

A paper cassette feeder and an image forming apparatus having the same are provided. The paper cassette feeder includes: a main frame; a loading unit on which paper is loaded; a first paper guide which is tilted up with respect to the loading unit; and a second paper guide which is disposed at the first paper guide in a turnable manner, and is tilted up with respect to the first paper guide according to a position of the second paper guide. Accordingly, a paper cassette feeder can be easily separated from an image forming apparatus when paper is jammed in a paper feeding path, so as to remove a paper jam easily.

17 Claims, 6 Drawing Sheets

PAPER CASSETTE FEEDER FOR EASILY REMOVING PAPER JAM AND IMAGE FORMING APPARATUS HAVING THE SAME

CROSS-REFERENCE TO RELATED APPLICATIONS

This application claims all benefits accruing under 35 U.S.C. §119 from Korean Patent Application No. 2006-4172, filed on Jan. 14, 2006, in the Korean Intellectual Property Office, the disclosure of which is incorporated herein in its entirety by reference.

BACKGROUND OF THE INVENTION

1. Field of the Invention

The present invention relates to an image forming apparatus having the same, and more particularly, to a paper cassette feeder that can be easily separated from an image forming apparatus when paper is jammed in a paper feeding path, thereby removing a paper jam easily, and an image forming apparatus having the same.

2. Related Art

A typical image forming apparatus, such as a printer, a photo-copier, a facsimile machine, and a multi-functional product, is provided with a charging process that charges the surface of a photoconductor, such as a photosensitive drum, to an electric potential; an exposing process that irradiates light onto the surface of the photoconductor from a light scanning unit, such as a laser scanning unit, and forms an electrostatic latent image on the surface of the photoconductor; a developing process that develops the electrostatic latent image into a visible toner image by supplying toner developing material onto the electrostatic latent image; a paper feeding process that feeds a printable medium such as paper along a paper feeding path after picking up the printing paper from a paper cassette feeder; a transfer process that transfers the toner image from the photoconductor onto the printing paper; a fixing process that fixes the toner image onto the printing paper by applying a high temperature and pressure; and a discharging process that discharges the printing paper after forming an image from an image forming apparatus.

Such an image forming apparatus, which forms an image on a printable medium such as paper as described, includes a paper cassette feeder (hereinafter referred to as a main cassette feeder) on which 150~250 sheets of paper can be loaded. To use more paper sheets, a secondary cassette feeder (SCF) is further included in the main frame of the image forming apparatus. The SCF operates based on its own driving mechanism. Normally, the SCF is disposed at a lower part of the main cassette feeder to provide additional paper sheets, and includes a pick-up roller and a conveying roller. The pick-up roller supplies the paper, which is loaded on the secondary cassette feeder (SCF), to the image forming apparatus. In general, the conveying roller is called an intermediate roller.

One or more paper guides are included in the main cassette feeder and the main frame of the image forming apparatus to facilitate conveying of the paper, complementarily. When paper is fed from the SCF to the main frame of the image forming apparatus, the paper may be jammed in a paper feeding path. If the paper is tightly jammed between the paper guide of the main cassette feeder and the paper guide of the main frame, the jammed paper functions as a binding member that tightly binds the two paper guides.

In this situation, a user must separate the main cassette feeder from the main frame of the image forming apparatus in order to remove the jammed paper. However, since the jammed paper is not easily removed, the user usually pulls the main cassette feeder by an excessive force so as to separate the main cassette feeder from the main frame of the mage forming apparatus. Unfortunately, when an excessive force is used to pull the main cassette feeder, the jammed paper can be torn easily and frequently.

SUMMARY OF THE INVENTION

Several aspects and example embodiments of the present invention advantageously provide a cassette feeder for use in an image forming apparatus that can be easily separated from the image forming apparatus when paper is jammed in a paper feeding path, thereby removing a paper jam easily, and an image forming apparatus having the same.

Additional aspects and/or advantages of the invention will be set forth in part in the description which follows and, in part, will be obvious from the description, or may be learned by practice of the invention.

In accordance with an embodiment of the present invention, there is provided a paper cassette feeder of an image forming apparatus, comprising: a main frame; a loading unit on which paper is loaded; a first paper guide which is tilted up with respect to the loading unit; and a second paper guide which is disposed at the first paper guide in a turnable manner, and is tilted up with respect to the first paper guide according to a position of the second paper guide.

In accordance with another embodiment of the present invention, there is provided an image forming apparatus comprising: a main frame; a printing unit which prints an image onto paper, and is disposed in the main frame; a main cassette feeder which feeds the paper to the printing unit, and is disposed in the main frame in a detachable manner; a second cassette feeder which supplies additional paper to the printing unit, and is placed at a lower part of the main frame; and a third paper guide which guides the paper fed from the main cassette feeder or the second cassette feeder to the printing unit, and is disposed in the main frame, wherein the main cassette feeder includes a main frame, a loading unit on which paper is loaded, a first paper guide which is tilted up with respect to the loading unit, and a second paper guide which is disposed at the first paper guide in a turnable manner, and is tilted up with respect to the first paper guide according to a position of the second paper guide.

According to an aspect of the present invention, the second paper guide and the first paper guide may form a first paper feeding path through which the paper is fed into the image forming apparatus from the loading unit.

According to another aspect of the present invention, the second paper guide may normally stay at a position for blocking the first paper feeding path, and is turned to a position for opening the first paper feeding path when pushed by a feeding paper as the paper is being fed from the main cassette feeder through the first paper feeding path.

According to an aspect of the present invention, a through-hole may be formed near the first and second paper guides of the main frame of the main cassette feeder, and may be perpendicular to a flat surface of the main frame of the main cassette feeder.

According to another aspect of the present invention, another through-hole may be formed at the second cassette feeder connected to the through-hole of the main cassette feeder, and the through-holes form a second paper feeding path through which the paper is fed from the second cassette feeder to the main cassette feeder.

According to an aspect of the present invention, the second paper guide may be joined with the first paper guide by using a hinge. In addition, an elastic member may be further comprises to join the first paper guide and the second paper guide, wherein the second paper guide is elastically biased by the elastic member in a direction for opening the first paper feeding path.

According to an aspect of the present invention, a plurality of the second paper guides may be disposed at the first paper guide to be separated from one another. In addition, the third paper guide may be parallel to the longitudinal direction of the second paper guide.

According to another aspect of the present invention, the second and third paper guides may be disposed in a zigzag manner, so that, when the paper is fed through the second paper feeding path and a portion of one surface of the paper faces the second paper guide (or the third paper guide), the corresponding portion of other end of the paper does not face the third paper guide (or the second paper guide).

According to an aspect of the present invention, a lower end of the third paper guide may be lower than an upper end of the second paper guide with respect to a flat surface of the main frame of the cassette feeder in a state that the second paper guide is turned to a position for opening the first paper feeding path.

According to an aspect of the present invention, the paper may be jammed in the second paper feeding path, and the main cassette feeder is separated from the main frame of the image forming apparatus so as to remove the jammed paper. The second paper guide is pushed by the jammed paper, and is turned to the position for blocking the first paper feeding path.

In accordance with yet another example embodiment of the present invention, an image forming apparatus comprises a main body including a printing unit for printing each sheet of paper; a first cassette feeder detachably mounted into the main body, to feed the individual sheet of paper to the image forming unit along a first paper feeding path; a second cassette feeder detachably mounted into the main body, to supply additional sheets of paper to the image forming unit along a second paper feeding path; and a main paper guide fixed to the main frame, to guide the individual paper fed from the first cassette feeder along the first paper feed path or the second cassette feeder along the second paper feed path, to the printing unit for printing each sheet of paper, wherein the first cassette feeder includes a loading unit to load the individual sheet of paper; a first paper guide tilted up with respect to the loading unit to guide the individual sheet of paper picked up from the loading unit along the first paper feeding path; and at least one second paper guide disposed at the first paper guide that is rotatable between a position for opening the first paper feeding path and a position for blocking the first paper feeding path.

In addition to the example embodiments and aspects as described above, further aspects and embodiments of the present invention will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
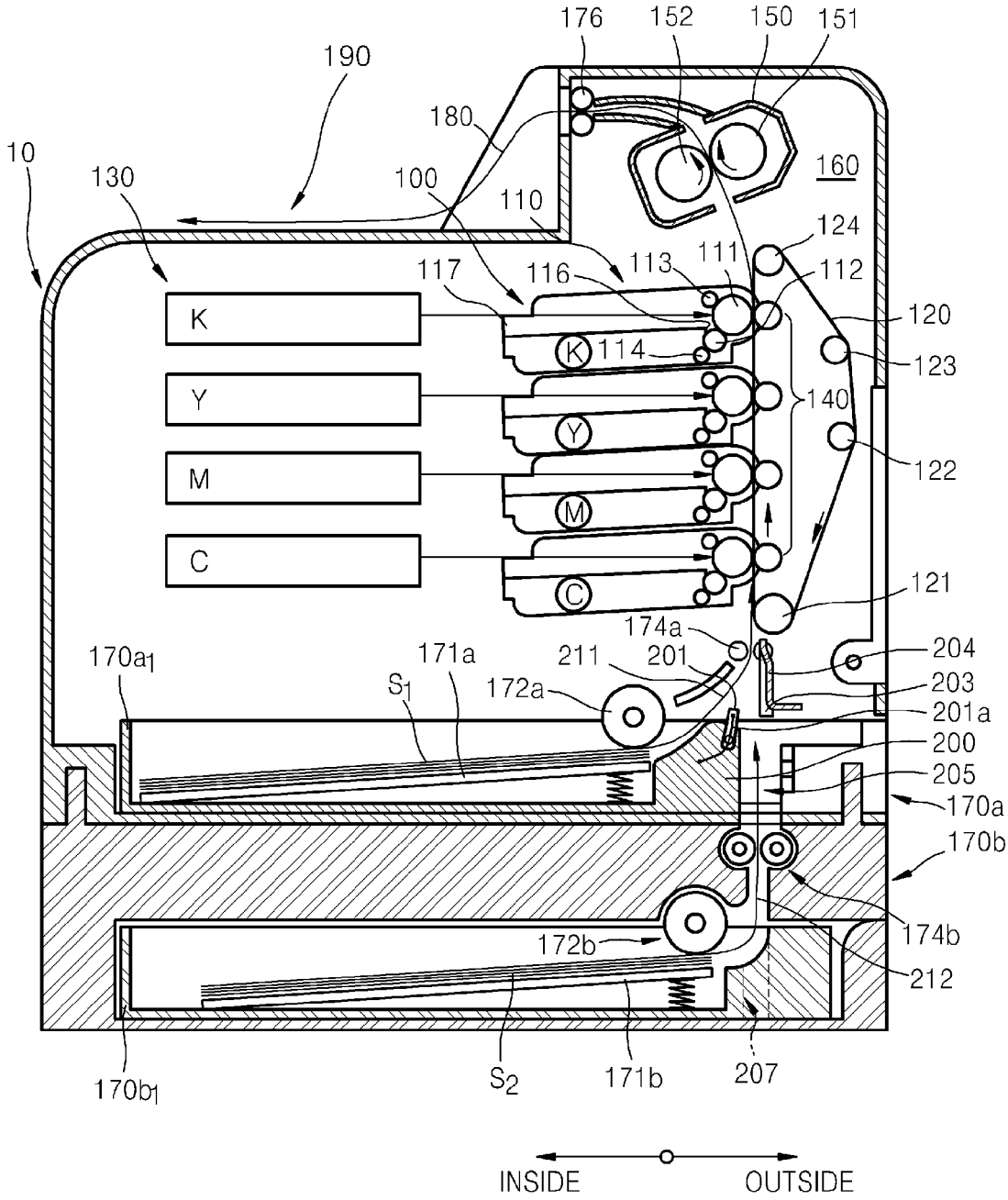
FIG. 1 is a schematic lateral cross-sectional view of an image forming apparatus according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
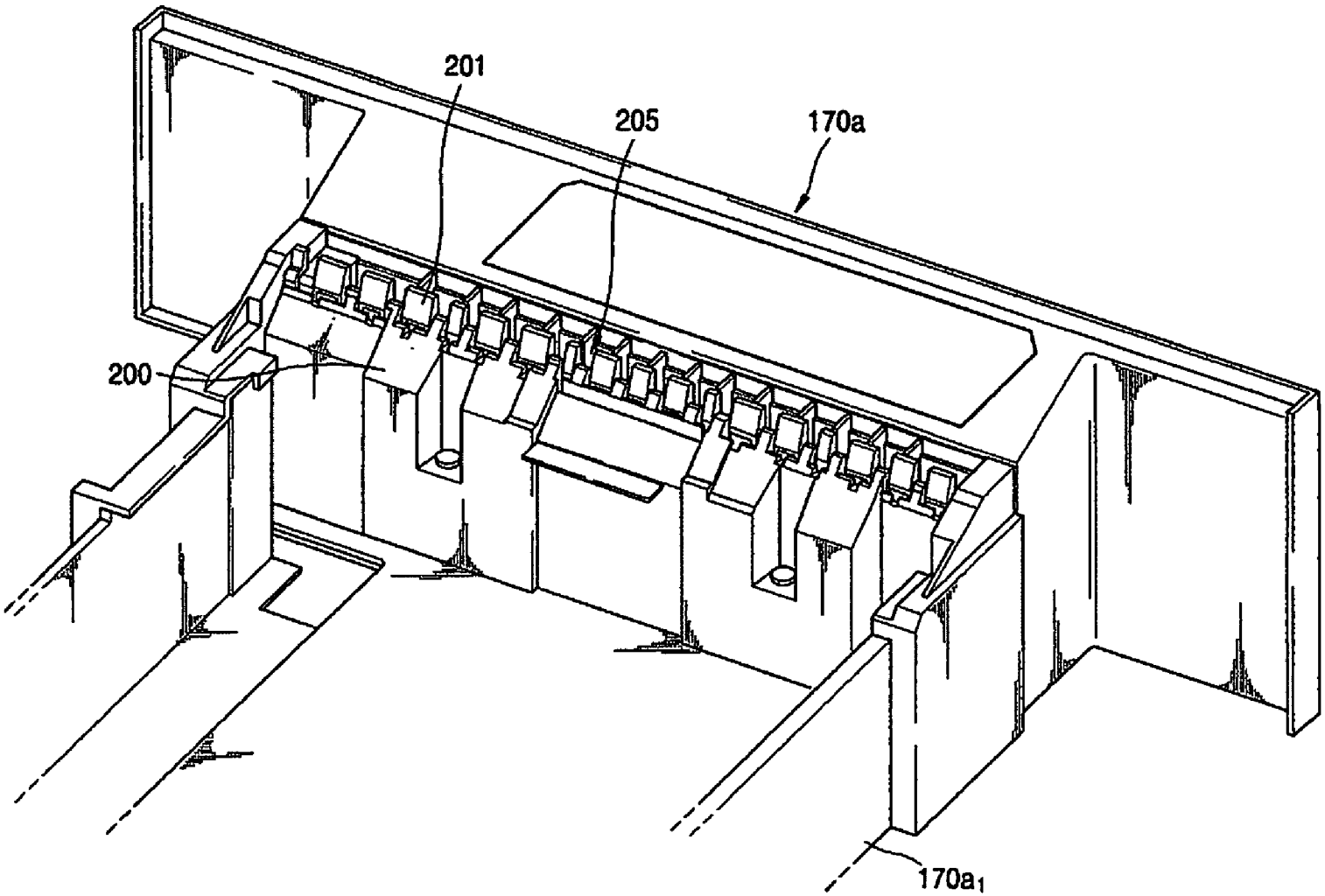
FIG. 2 is a perspective view of a main cassette feeder shown in FIG. 1, slantly viewed from the top.
Figure 3:
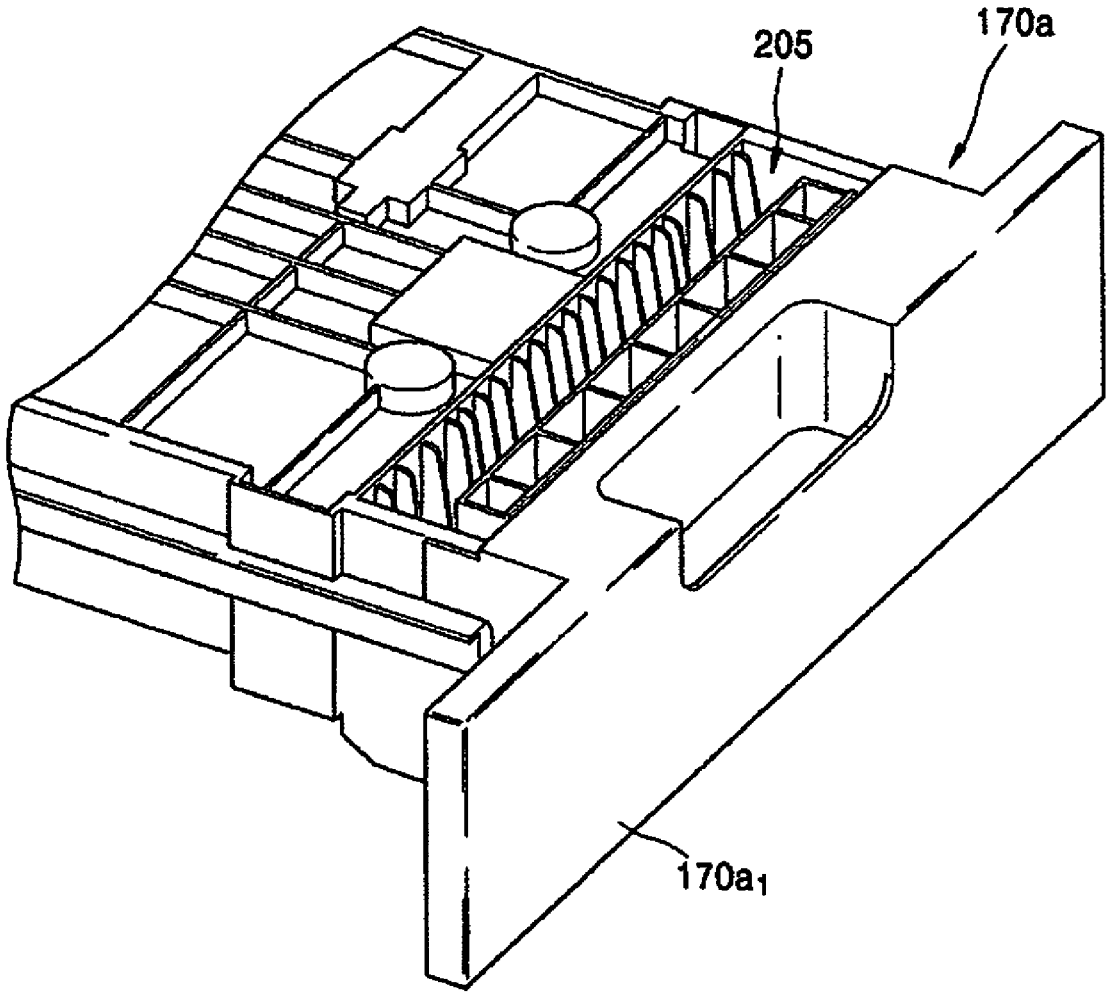
FIG. 3 is a perspective view of the main cassette feeder shown in FIG. 1, slantly viewed from the bottom.
Figure 4:
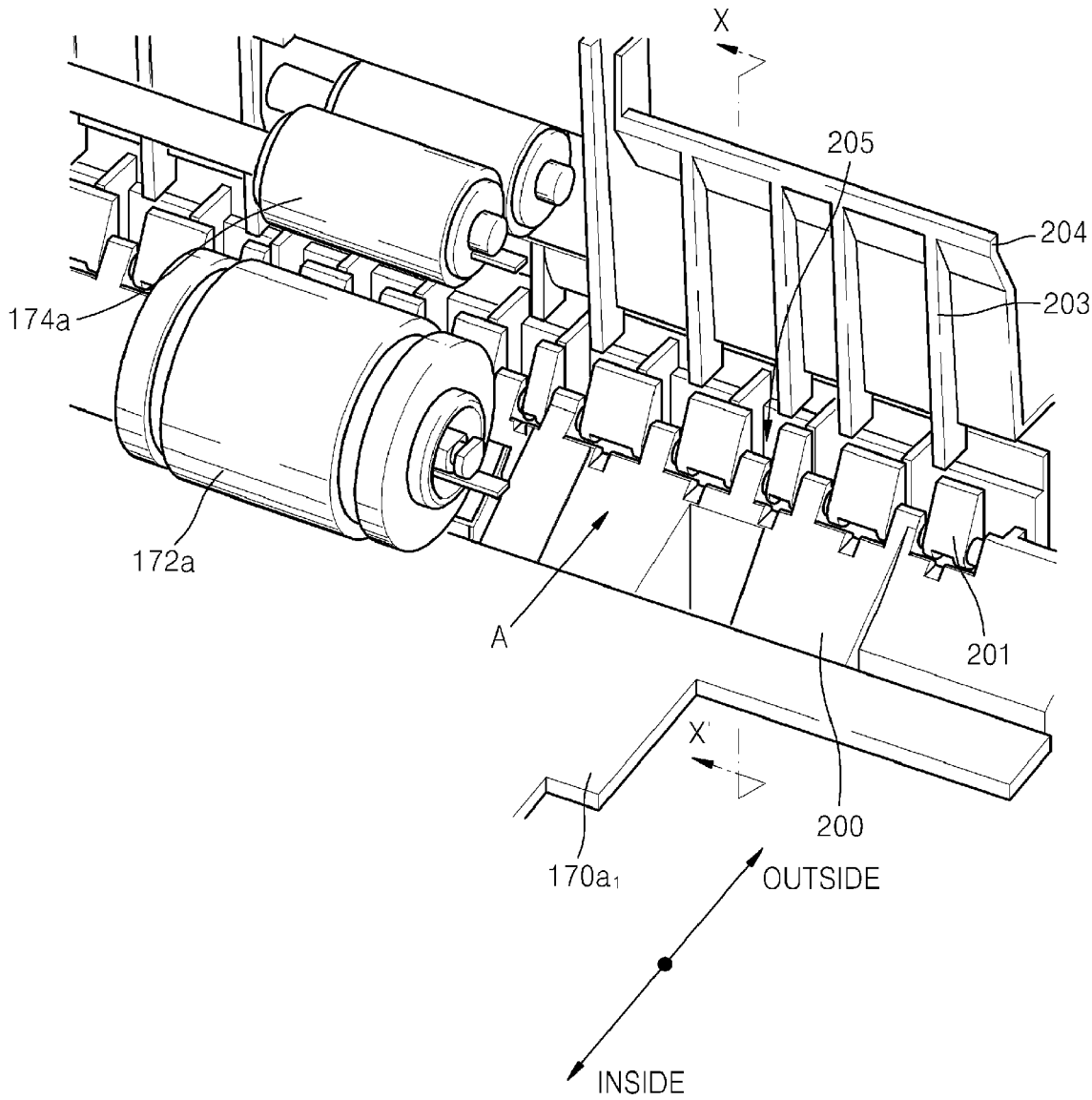
FIG. 4 is an extracted perspective view of a portion of a cassette feeder included in the image forming apparatus shown in FIG. 1.

FIG. 1 is a schematic lateral cross-sectional view of an image forming apparatus according to an embodiment of the present invention. FIG. 2 is a perspective view of a main cassette feeder included in the image forming apparatus shown in FIG. 1, slantly viewed from the top. FIG. 3 is a perspective view of the main cassette feeder included in the image forming apparatus shown in FIG. 1, slantly viewed from the bottom. FIG. 4 is an extracted perspective view of a portion of the main cassette feeder included in the image forming apparatus shown in FIG. 1.

Referring to FIG. 1, the image forming apparatus includes a main frame 10; a printing unit (i.e., image forming unit) 160 for printing an image onto an individual sheet of paper S1 or S2 through an electro-photographic process; a main cassette feeder 170*a* for feeding the individual sheet of papers S1 and S2 to the printing unit 160; and a second cassette feeder 170*b* for supplying additional sheets of paper to the printing unit 160.

The printing unit 160 includes four developing cartridges 110, a transfer belt 120, four light exposing unit 130, four transfer rollers 140, and a fixing unit 150. The four developing cartridges 110 contain cyan C, magenta M, yellow Y, and black K toners, respectively.

The transfer belt 120 is supported by a plurality of supporting rollers 121, 122, 123, and 124, and travels in circle. At least one of the supporting rollers 121, 122, 123, and 124 is driven by a main motor (not shown), and the rest of the supporting rollers rotate along with the driven supporting roller.

Each light exposing unit 130 irradiates light, which corresponds to information on cyan C, magenta M, yellow Y, and black K images, onto the photosensitive drums 111 of the developing cartridges 110 in response to a control signal.

Each developing cartridge 110 includes a photosensitive drum 111, a developing roller 112, a charging roller 113, a supply roller 114, and a restriction member 116. A portion of the surface of the photosensitive drum 111 is exposed. In addition, the photosensitive drum 111 rotates in a particular direction, and a photoconductive material is coated on the surface of the photosensitive drum 111.

A charging bias voltage is applied to the charging roller 113, to equipotentially charge the surface of the photosensitive drum 111. A corona discharger (not shown) may be used instead of the charging roller 113. Toner adheres to the surface of the developing roller 112 so as to be supplied to the photosensitive drum 111. The developing roller 112 contains powder type toner, and supplies the toner to an electrostatic latent image formed on the photosensitive drum 111, thereby developed into a toner image. A developing bias voltage is applied to the developing roller 112 so as to supply the toner to the photosensitive drum 111.

In an outer frame 100 of the developing roller 112, the supply roller 114 and the restriction member 116 are disposed. The supply roller 114 makes the toner adhere to the developing roller 112, and the restriction member 116 restricts the amount of toner adhered to the developing roller 112.

Each developing cartridge 110 includes an aperture 117 which forms a path through which the light irradiated by the light exposing unit 130 is irradiated onto the photosensitive drum 111. The exposed surface of the photosensitive drum 111 faces the transfer belt 120.

The four transfer rollers 140 are arranged to face the photosensitive drums 111 of the developing cartridges 110, with the transfer belt 120 being disposed between the four transfer rollers 140 and the photosensitive drums 111. When one or more supporting rollers 121, 122, 123, and 124 rotate, the transfer belt 120 travels in circle along with the one or more rotating supporting rollers, thereby rotating the transfer rollers 140. To transfer the toner image, which is developed on the photosensitive drum 111, onto the individual sheet of paper S1 or S2, a transfer bias voltage having the opposite polarity with respect to the toner image is applied to the transfer rollers 140. The toner image is transferred onto the individual sheet of paper S1 or S2 by an electrostatic force acting between the photosensitive drum 111 and the transfer roller 140.

As a method of transferring the toner image developed on the surface of the photosensitive drum 111 on the individual sheet of paper S1 or S2, a direct transfer method is used in this example embodiment. However, an indirect transfer method may be used in another embodiment, in which the toner image on the photosensitive drum 111 is first transferred onto a transfer belt (not shown), and then the toner image transferred onto the transfer belt is retransmitted to the papers S1 and S2.

The fixing unit 150 includes a heat roller 151 and a pressure roller 152, and fixes the toner image onto the individual sheet of paper S1 or S2 by applying heat and pressure on the toner image transferred onto the individual sheet of paper S1 or S2. The heat roller 151 is a heat source for fixing the toner image permanently, and faces the pressure roller 152 in its axis direction. The pressure roller 152 faces the heat roller 151, and fixes the toner image onto the individual sheet of paper S1 or S2 by applying a high pressure thereto.

After an image is fixed onto the individual sheet of paper S1 or S2, a discharging roller 176 discharges the individual sheet of paper S1 or S2 from the image forming apparatus. The papers S1 and S2 are then discharged from the printing unit 160 through the discharging roller 176 along a paper conveying path 180, and are loaded on a loading unit 190.

Referring back to FIG. 1, the image forming apparatus also includes a main cassette feeder 170*a* and a second cassette feeder 170*b*. The main cassette feeder 170*a* is located at a lower part of the image forming apparatus, and the second cassette feeder 170*b* supplies additional sheets of paper to the printing unit 160, if necessary.

The main cassette feeder 170*a* includes a main frame 170*a*1, a loading unit 171*a* for loading the individual sheet of paper S1 thereon, and first and second paper guides 200 and 201.

The first paper guide 200 is tilted up with respect to the loading unit 171*a*. The second paper guide 201 is disposed at the first paper guide 200 in a turnable manner. For example, the second paper guide 201 is joined with the first paper guide 200 by using a hinge, and may be tilted up with respect to the first paper guide 200 according to a position of the second paper guide 201. As a result, a first paper feeding path 211 is formed by the first paper guide 200 and the second paper guide 201, and the individual sheet of paper S1 is supplied into the printing unit 160 included in the image forming apparatus from the loading unit 171*a* along the first paper feeding path 211.

Due to its own weight, the second paper guide 201 usually stays at a position for blocking the first paper feeding path 211. When the paper S1 is supplied from the main cassette feeder 170*a* through the first paper feeding path 211, the second paper guide 201 is pushed by the feeding paper S1, and is turned to a position for opening the first paper feeding path 211. By doing so, when the individual sheet of paper S1 is fed from the main cassette feeder 170*a*, the front end of the feeding paper S1 is snagged by the second paper guide 201, and thus the paper S1 cannot be fed for some time, during which time the front end of the paper S1 can be aligned.

However, the present invention is not limited thereto. An elastic member 201*a* may be further included to join the first paper guide 200 and the second paper guide 201. In addition, the second paper guide 201 may be elastically biased in a direction for opening the first paper feeding path 211 by the elastic member 201*a*.

Turning now to FIG. 2 and FIG. 3, perspective views from the top and the bottom of the main cassette feeder included in the image forming apparatus shown in FIG. 1, are illustrated. As shown in FIG. 2, a plurality of the second paper guides 201 are disposed at the first paper guide 200 to be separated from one another. By doing so, the second paper guide 201 can be disposed between third paper guides 203 (to be described later). As a result, the main cassette feeder 170*a* can be easily inserted into and separated from the image forming apparatus. In addition, by changing locations of the second and third paper guides 201 and 203, a paper jam may be prevented in the first paper feeding path 211. The process of preventing the paper jam will be described later.

A through-hole 205 is formed near the first and second paper guides 200 and 201 of the main frame 170*a*1 of the main cassette feeder 170*a*, and is perpendicular to the base of the main frame 170*a*1 of the main cassette feeder 170*a*. The through-hole 205 forms a second paper feeding path 212 through which the paper S2 is supplied from the second cassette feeder 170*b*, as shown in FIG. 1, to the printing unit 160 included in the image forming apparatus. By doing so, when all the sheets of paper S1 loaded on the main cassette feeder 170*a* are all consumed, the individual sheet of paper S2 loaded on the second cassette feeder 170*b* is supplied to the printing unit 160 through the through-hole 205 by way of conveying rollers 174*b*. To do so, the width of the through-hole 205 may be wider (larger) than the thickness of the sheet of paper S2. FIG. 3 shows the location and shape of the through-hole 205 formed in the main cassette feeder 170*a*.

The individual sheet of paper S1 loaded on the main cassette feeder 170*a* is picked up by a pick-up roller 172*a*, and is conveyed towards the printing unit 160 included in the image forming apparatus, shown in FIG. 1.

The second cassette feeder 170*b* includes a main frame 170*b*1, a loading unit 171*b* for loading the individual sheet of paper S2 thereon, a pick-up roller 172*b*, and a conveying roller 174*b*.

The loading unit 171*b* loads the individual sheet of paper S2 thereon, and is disposed in the main frame 170*b*1 of the second cassette feeder 170*b*. The pick-up roller 172*b* picks up the individual sheet of paper S2 loaded on the loading unit 171*b*, and supplies the picked-up sheet of paper S2 to the printing unit 160 included in the image forming apparatus, shown in FIG. 1, via the second paper feeding path 212. The conveying roller 174*b* conveys the paper S2 supplied by the pick-up roller 172*b* to a conveying roller 174*a* included in the main frame 10 of the image forming apparatus, shown in FIG. 1.

Meanwhile, two or more second cassette feeders may be placed at a lower part of the main frame 10 of the image forming apparatus. In this case, at least one additional second cassette feeder can be disposed between the main cassette feeder 170*a* and a second cassette feeder 170*b* placed at the lowest position, and has another through-hole 207 (FIG. 1) connected to the through-hole 205 of the main cassette feeder 170*a*. The through-holes form the second paper feeding path 212, through which the individual sheet of paper S2 is fed from the second cassette feeder 170*b* to the printing unit 160 included in the image forming apparatus, as shown in FIG. 1.

A third paper guide 203 is disposed in the main frame 10 of the image forming apparatus, shown in FIG. 1, so as to guide the individual sheet of paper S1 or S2 fed from the main cassette feeder 170*a* or the second cassette feeder 170*b*. The third paper guide 203 is supported by a paper guide supporting unit 204 disposed in the main frame 10 of the image forming apparatus. The third paper guide 203 is disposed in parallel to the longitudinal direction of the second paper guide 201.

FIG. 4 shows the first, second, and third paper guides 200, 201, and 203, the pick-up roller 172*a*, and the conveying roller 174*a*. Specifically, the first paper guide 200 faces the pick-up roller 172*a*, and is titled up with respect to the main frame 170*a*1 of the main cassette feeder 170*a*. With being separated from one another, a plurality of the second paper guides 201 are disposed at the first paper guide 200 in a turnable manner, and are tilted up with respect to the first paper guide 200. The paper guide supporting unit 204 having the third paper guide 203 is disposed between the pick-up roller 172*a* and the conveying roller 174*a*. With the main cassette feeder 170*a* being placed in the main frame 10 of the image forming apparatus, the through-hole 205 is formed between the second paper guide 201 and the third paper guide 203, and serves as the second paper feeding path 212.

Figure 5:
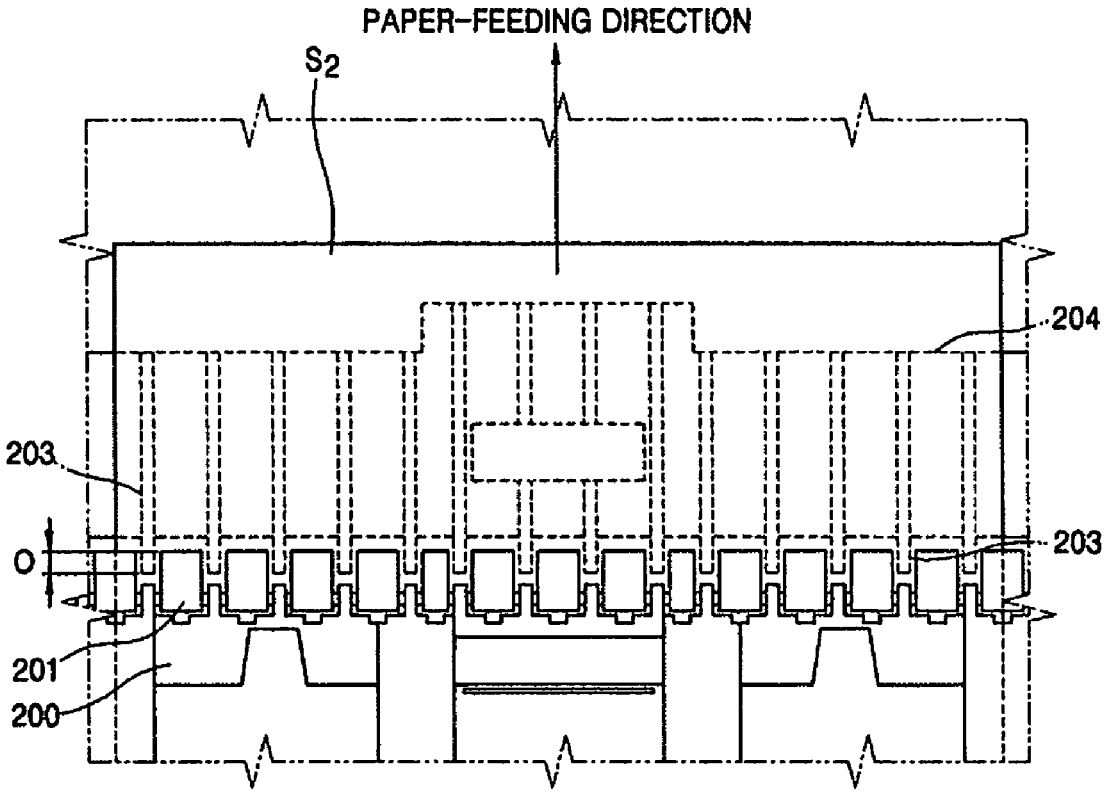
FIG. 5 is a schematic view of an arrangement of paper guides shown in FIG. 4.

FIG. 5 is a schematic view of an arrangement of paper guides shown FIG. 4. As shown in FIG. 5, the feeding paper S2 is guided by the second and third paper guides 201 and 203, along a paper feeding direction A shown in FIG. 4. The paper S2 is fed from the second cassette feeder 170*b* through the second paper feeding path 212. As mentioned above, the second paper guide 201 may be elastically biased by the elastic member 201*a* in the direction for opening the first paper feeding path 211, as shown in FIG. 1.

Referring to FIG. 5, the feeding paper S2 passes between the second paper guide 201 and the third paper guide 203. In this case, if a portion of one surface of the paper S2 faces the second paper guide 201 (or the third paper guide 203), then the corresponding portion of the other surface of the paper S2 must not face the third paper guide 203 (or the second paper guide 201). In other words, the second and third paper guides 201 and 203 are disposed in a zig-zag manner, so that the both surfaces of the paper S2 are not supported by the paper guides 201 and 203 at the same time.

Figure 6A:
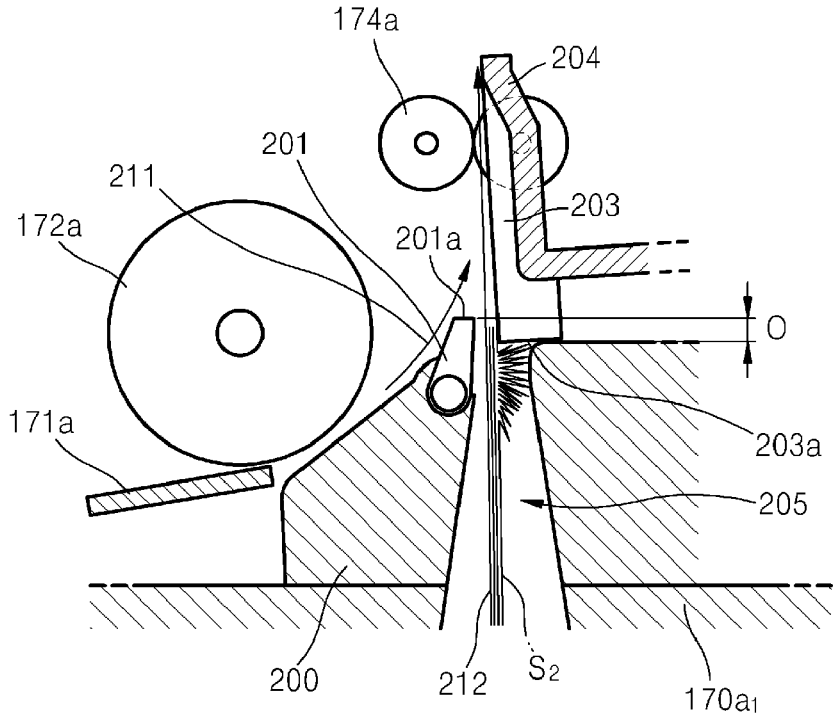
FIGS. 6A and B are lateral cross-sectional views of a paper feeding structure shown in FIG. 4 and taken along line X-X', to illustrate a paper jam removing operation.

The third paper guide 203 is disposed such that, when the front end of the paper S1 fed through the first paper feeding path 211 escapes from the second paper guide 201, a portion of the third paper guide 203 can immediately guide the paper S1. In other words, a lower end of the third paper guide 203 is overlapped with an upper end of the second paper guide 201. Thus, as shown in FIG. 5, an overlap area "O" exists between the second and third paper guides 201 and 203. If the overlap area "O" does not exist between the second and third paper guides 201 and 203, the front end of the paper S1 does not come in contact with the third paper guide 203 immediately after the front end thereof escapes from the second paper guide 201, when the paper S1 is fed from the main cassette feeder 170*a* to the first paper feeding path 211, that is, the paper feeding direction A as shown in FIG. 4. As a result, a paper jam is highly likely to occur between the second and third paper guides 201 and 203. FIGS. 6A and B are lateral cross-sectional views of the second and third paper guides 201 and 203, to illustrate a paper jam removing operation, which will be described later.

In order that the main cassette feeder 170*a* is inserted into or separated from the main frame 10 of the image forming apparatus, shown in FIG. 1, in the case that the overlap area "O" exists between the second and third paper guides 201 and 203, the second and third paper guides 201 and 203 must be disposed in a zig-zag manner as described above. This is because the second paper guide 201 is positioned far inside of the main frame 10 of the image forming apparatus with respect to the third paper guide 203 as shown in FIGS. 1 and 4, with the main cassette feeder 170*a* being placed in the main frame 10 of the image forming apparatus. For this reason, when the main cassette feeder 170*a* is separated from the main frame 10 of the image forming apparatus, the second paper guide 201 needs to be deviated from the third paper guide 203 after the second paper guide 201 is moved towards the third paper guide 203.

FIGS. 6A and B are lateral cross-sectional views of the paper feeding structure shown in FIG. 4. Referring to FIGS. 6A and B, the process of removing a paper jam will be described herein below.

FIG. 6A shows a paper jam that occurs between the conveying roller 174*a* and the second paper feeding path 212, when the paper S2 is fed through the second paper feeding path 212. Here, the second paper guide 201 is turned to the position for opening the first paper feeding path 211. In this case, the second paper guide 201 is elastically biased by the elastic member (not shown) in the direction for opening the first paper feeding path 211. However, the present invention is not limited thereto, and the second paper guide 201 may usually stay at the position for blocking the first paper feeding path 211. When the paper S1 is fed from the main cassette feeder 170*a* through the first paper feeding path 211, the second paper guide 201 may be pushed by the feeding paper S1, and thus may be turned to the position for opening the first paper feeding path 211.

Referring to FIGS. 4 and 6A, when the second paper guide 201 is turned to the position for opening the first paper feeding path 211, a lower end 203*a* of the third paper guide is disposed lower than an upper end 201*a* of the second paper guide with respect to the base of the main frame 170*a*1 of the main cassette feeder 170*a*. The reason for this is described in detail with reference to FIG. 5.

Figure 6B:
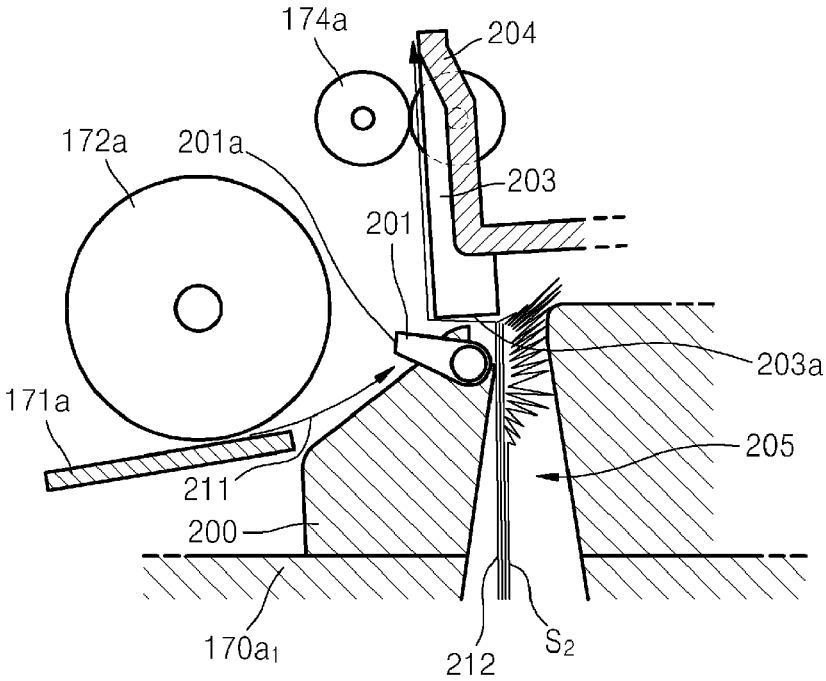

FIG. 6B shows how a jammed paper is removed by separating the main cassette feeder 170*a* from the main frame 10 of the image forming apparatus, shown in FIG. 1.

If the main cassette feeder 170*a* is separated from the main frame 10 of the image forming apparatus in a condition that the second paper guide 201 is elastically biased in a specific direction as shown in FIG. 6A, the second paper guide 201 is also moved in the same direction that the main cassette feeder 170*a* moves. As a result, the second paper guide 201 comes in contact with the jammed paper S2. The second paper guide 201 is pushed by the jammed paper S2, and is turned to the position for blocking the first paper feeding path 211. Thus, the main cassette feeder 170*a* can be easily separated from the main frame 10 of the image forming apparatus. Also, the jammed paper S2 can be easily removed by separating the main cassette feeder 170*a* from the main frame 10 of the image forming apparatus, shown in FIG. 1.

However, if the second paper guide 201 is fixed to the first paper guide 200 at the position for opening the first paper feeding path 211, or if the first and second paper guides 200 and 201 are formed in a built-in manner, the jammed paper S2 functions as a binding member for binding the paper guides 200 and 201 as in the case of the conventional art. Thus, the main cassette feeder 170*a* is hardly separated from the main frame 10 of the image forming apparatus until the jammed paper S2 is torn.

Meanwhile, when the second paper guide 201 can be turned to the position for blocking the first paper feeding path 211, not only the jammed paper is easily removed from the main cassette feeder 170*a*, but also the front end of the paper S1 picked-up from the loading unit 171*a* can be aligned prior to being conveyed into the printing unit 160, via the conveying rollers 174*a*. This is because, when the paper S1 is fed from the main cassette feeder 170*a*, the front end of the paper S1 collides with the second paper guide 201, thereby aligning the front end of the paper S1.

Accordingly, the present invention advantageously provides a paper cassette feeder that can be easily separated from an image forming apparatus when paper is jammed in a paper feeding path, thereby removing a paper jam easily, and an image forming apparatus having the same. In addition, the present invention also provides a paper cassette feeder that can align the front end of paper, and an image forming apparatus having the same.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. Accordingly, it is intended, therefore, that the present invention not be limited to the various example embodiments disclosed, but that the present invention includes all embodiments falling within the scope of the appended claims.

What is claimed is:

1. A paper cassette feeder for use in an image forming apparatus, comprising:

a cassette frame;

a loading unit disposed inside the cassette frame, to load sheets of paper;

a first paper guide provided on the main frame, to guide the paper along a first paper feeding path, as the paper is picked up from the loading unit; and one or more second paper guides movably attached to the first paper guide, to rotate between a first position to open the first paper feeding path, and a second position to block the first paper feeding path, wherein, a through-hole is formed in the cassette frame adjacent to the first and second paper guides, through which paper is fed from another cassette feeder into the image forming apparatus, and when the paper is jammed in the through-hole, and the paper cassette feeder is pulled from the image forming apparatus to remove the jammed paper, the one or more second paper guides are pushed by the jammed paper and are rotated to a position for blocking the paper feeding path.

2. The paper cassette feeder as claimed in claim 1, wherein the one or more second paper guides are arranged at the second position for blocking the paper feeding path, and are rotated to the first position for opening the paper feeding path when each sheet of paper picked up from the loading unit is fed into the image forming apparatus.

3. The paper cassette feeder as claimed in claim 1, wherein the plurality of second paper guides are joined with the first paper guide at their distal ends, using a hinge.

4. A paper cassette feeder of an image forming apparatus, comprising:

a cassette frame;

a loading unit on which paper is loaded;

a first paper guide provided on the cassette frame, to guide the paper along a first paper feeding path, as the paper is picked up from the loading unit;

a second paper guide movably attached to the first paper guide;

an elastic member to join the first paper guide and the second paper guide, wherein a through-hole is provided in the cassette frame to form a second paper feeding path through which a paper can be supplied from another paper cassette feeder disposed below, wherein the second paper guide has a first guide surface to guide the paper picked up from the loading unit along the first paper feeding path and a second guide surface to guide a paper picked up from another paper cassette feeder located below along the second paper feeding path, wherein the paper cassette feeder is detachably installed in the image forming apparatus, and wherein, when the paper is jammed in the second paper feeding path, and the paper cassette feeder is pulled from a main frame of the image forming apparatus to remove the jammed paper, the second paper guide pivots toward the first paper feeding path.

5. The paper cassette feeder as claimed in claim 4, wherein the second paper guide is attached to the first paper guide by using a hinge.

6. The paper cassette feeder as claimed in claim 4, wherein the second paper guide is adopted to block the first paper feeding path, unless the paper being picked up from the loading unit contacts the second paper guide.

7. The paper cassette feeder as claimed in claim 4, further comprising a plurality of the second paper guides disposed at the first paper guide to be separated from one another.

8. An image forming apparatus comprising:

a main frame;

a printing unit mounted in the main frame, which prints an image onto a paper;

a main cassette feeder detachably mounted in the main frame, which feeds the paper to the printing unit;

a second cassette feeder located below the main cassette feeder, which supplies additional paper to the printing unit; and a main frame paper guide disposed in the main frame, which guides at least one of the paper fed from the main cassette feeder or the second cassette feeder to the printing unit, wherein the main cassette feeder includes, a cassette frame, a loading unit on which paper is loaded, a first paper guide provided on the cassette frame, to guide the paper along a first paper feeding path, as the paper is picked up from the loading unit, and a second paper guide movably attached to the first paper guide, wherein a through-hole is provided in the cassette frame to form a second paper feeding path through which a paper picked up from the second cassette feeder is supplied to the printing unit, wherein the second paper guide of the main cassette feeder has a first guide surface to guide the paper picked up from the main cassette feeder along the first paper feeding path and a second guide surface to guide a paper picked up from the second cassette feeder along the second paper feeding path, wherein, when the paper is jammed in the second paper feeding path, and the main cassette feeder is pulled from the main frame of the image forming apparatus to remove the jammed paper, the second paper guide pivots toward the first paper feeding path.

9. The image forming apparatus as claimed in claim 8, wherein a lower end of the third paper guide is lower than an upper end of the second paper guide with respect to the based of the cassette frame, in a state that the second paper guide is turned to a position opening the first paper feeding path.

10. The image forming apparatus as claimed in claim 8, wherein the second paper guide is adopted to block the first paper feeding path, unless the second paper guide is pushed by the paper being picked up from the loading unit.

11. The image forming apparatus as claimed in claim 8, wherein when the paper is jammed in the second paper feeding path, and the main cassette feeder is pulled from the main frame of the image forming apparatus to remove the jammed paper, the second paper guide is pushed by the jammed paper and is moved to a position for blocking the first path.

12. The image forming apparatus as claimed in claim 8, wherein another through-hole is formed at the second cassette feeder connected to the through-hole of the main cassette feeder, and wherein the through-holes form a second paper feeding path through which the paper is fed from the second cassette feeder to the main cassette feeder.

13. The image forming apparatus as claimed in claim 8, wherein the second paper guide is joined with the first paper guide by using a hinge.

14. The image forming apparatus as claimed in claim 8, further comprising an elastic member to elastically bias the second paper guide away from the first paper feeding path.

15. The image forming apparatus as claimed in claim 8, wherein a plurality of the second paper guides are separately disposed at the first paper guide.

16. The image forming apparatus as claimed in claim 8, wherein the third paper guide is parallel to the longitudinal direction of the second paper guide.

17. The image forming apparatus as claimed in claim 8, wherein the second and third paper guides are disposed in a zig-zag manner, so that, when the paper is fed through the second paper feeing path and a portion of one surface of the paper faces the second paper guide or the third paper guide, the corresponding portion of the other surface of the paper does not face the third paper guide or the second paper guide.

* * * * *

UNITED STATES PATENT AND TRADEMARK OFFICE

CERTIFICATE OF CORRECTION

PATENT NO. : 7,871,067 B2
APPLICATION NO. : 11/640392
DATED : January 18, 2011
INVENTOR(S) : Kwang-taek Lim It is certified that error appears in the above-identified patent and that said Letters Patent is hereby corrected as shown below:

Column 11, Line 34 (Approx.), In Claim 9, delete “based” and insert --base--, therefor.

Column 12, Line 32, In Claim 17, delete “feeing” and insert --feeding--, therefor.

Signed and Sealed this
Fourteenth Day of June, 2011

David J. Kappos

David J. Kappos
*Director of the United States Patent and Trademark Office*